United States Patent [19]

Kaszyk

[11] 4,119,965

[45] Oct. 10, 1978

[54] RADAR REFLECTOR

[76] Inventor: Philip Kaszyk, 15 Nassau St., Pawtucket, R.I. 02860

[21] Appl. No.: 822,812

[22] Filed: Aug. 8, 1977

[51] Int. Cl.[2] ..... H01Q 15/18

[52] U.S. Cl. ..... 343/18 C

[58] Field of Search ..... 343/18 C

[56] References Cited

U.S. PATENT DOCUMENTS

| | | | |
|---|---|---|---|
| 2,475,633 | 7/1949 | Morris et al. | 343/18 C |
| 2,912,687 | 11/1959 | Leonard | 343/18 C |

*Primary Examiner*—T.H. Tubbesing

*Attorney, Agent, or Firm*—Salter & Michaelson

[57] ABSTRACT

A foldable radar reflective target in which top and bottom quarter plates are respectively connected to the top and bottom surfaces of a generally planar base plate. In a storage position, the quarter plates fold face-to-face with respect to said base plate, and in an upright position the quarter plates extend respectively above and below said base plate and terminate in upper and lower apices respectively. Joined to the apices of the plates are rings that are positioned with respect to each other such that a flexible line is received therethrough for maintaining the target in upright position and for suspending the same from the rigging of a small boat.

2 Claims, 2 Drawing Figures

FIG. 1
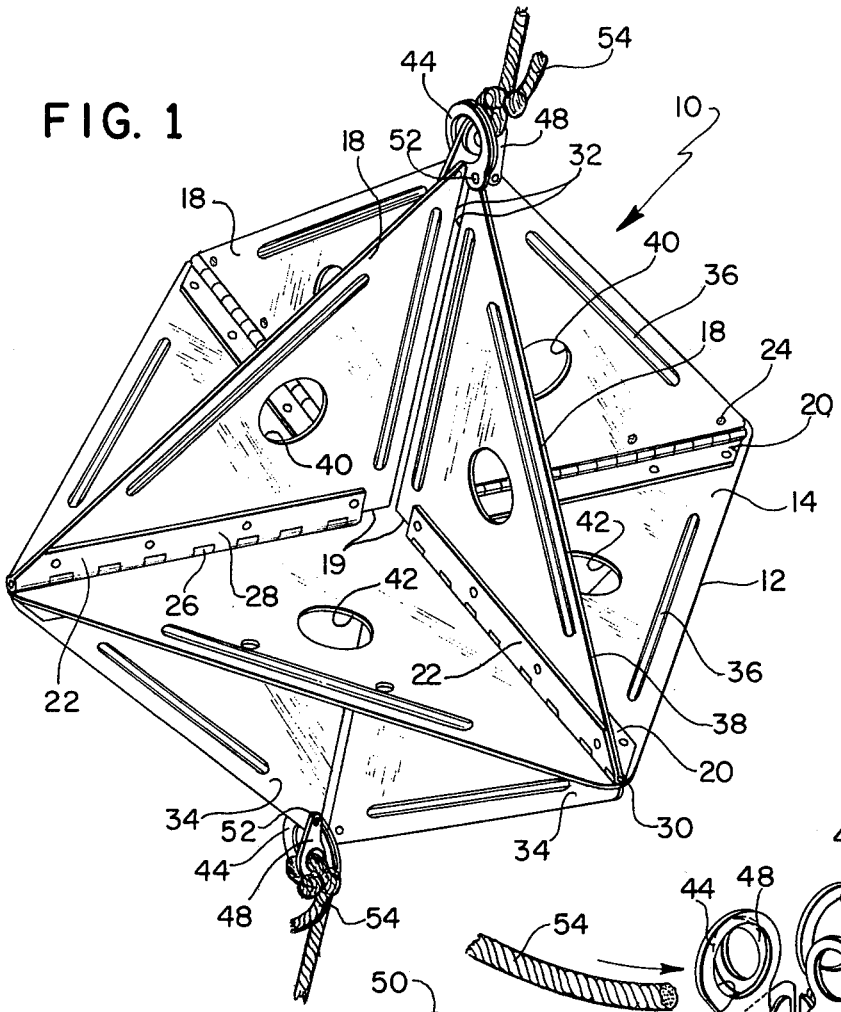
FIG. 2
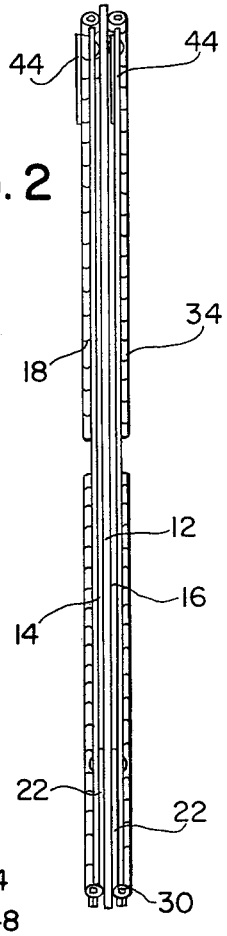
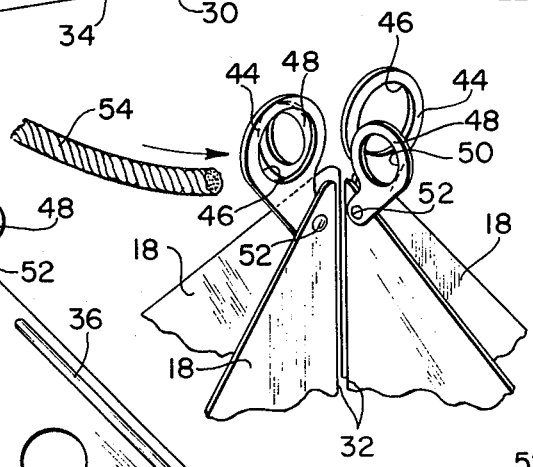
FIG. 4
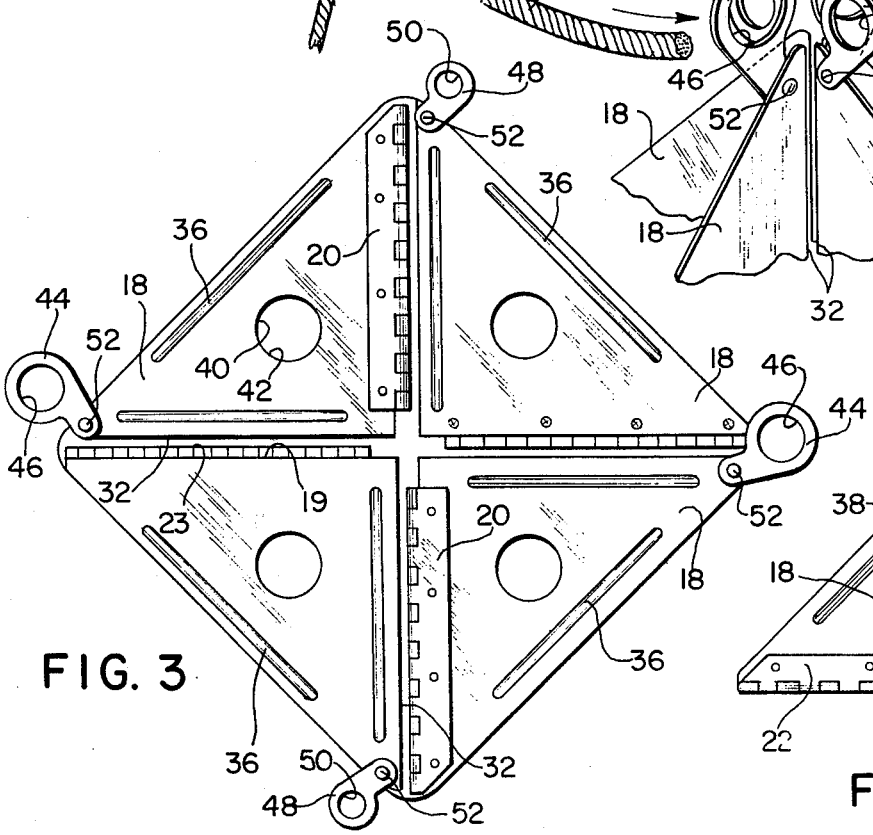
FIG. 3
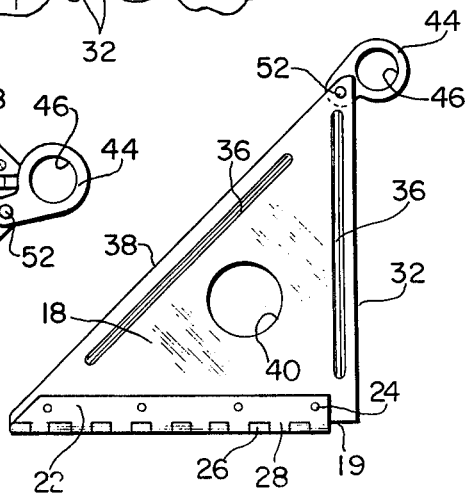
FIG. 5

RADAR REFLECTOR

BACKGROUND OF THE INVENTION

This invention relates to a radar target such as might be utilized on small boats so that they may be more readily "observable" in visually restricted weather or at night by the radar units of larger vessels. The invention more particularly relates to such a radar target which may be folded or collapsed to a relatively flat storage position when not in use.

Targets of this general type are known and include those disclosed in U.S. Pat. No. 2,912,687 to Leonard, U.S. Pat. No. 2,885,678 to Kirgan, and U.S. Pat. No. 2,778,010 to Leonard. In both the Leonard patents a base panel which is adapted for vertical orientation includes quarter panels connected both to the base panel and to each other and through which operating cords may be strung so that the target may be opened in place by pulling the operating cords in opposite directions. The patent to Kirgan shows a reflector target which includes separate connectors that are utilized to join triangular plates of a reflector target in open position, the upper connector thereof containing an eye or opening through which a cable is threaded, and a cable being utilized to move the various plates to an open position.

Despite the reflector constructions available as above indicated there still exists a need for a radar reflector of the foldable type which exhibits a greater degree of rigidity when located in its upright use attitude and which use position is positively maintained without complicated locking devices. Accordingly a primary object of the present invention is to provide a foldable radar reflector which has a particularly rigid construction when positioned in its use attitude, but which readily folds to a flat storage position.

A further object of the present invention is to provide a foldable radar reflector as described herein, wherein the means by which the reflector is suspended in use, furthermore maintains the reflector in its upright or use position.

A still further object of the present invention is to provide a radar reflector of simple and low-cost construction and that is easily erected to a position of use and collapsed to a storage position.

These and other objects of the present invention are accomplished by the use of a base plate to which four top quarter plates and four bottom quarter plates are hingedly connected along first base sides thereof. The quarter panels are movable from a face-to-face collapsed position with respect to the base plate to an upright attitude, in which second base sides of each top and bottom quarter panel are respectively aligned proximal to each other along a line that is generally vertical and perpendicular to the normal horizontal disposition of the base plate. Rings respectively having larger and smaller openings are provided at the lower and upper apices of the plates in such a manner that their interconnection enables a flexible line to be passed through the openings of the smaller rings, so as to simultaneously enable the reflector to be suspended from a boat while maintaining it in its upright use position.

Other objects, features and advantages of the invention shall become apparent as the description thereof proceeds when considered with the accompanying illustrative drawing.

DESCRIPTION OF THE DRAWING

In the drawings which illustrate the best mode presently contemplated for carrying out the present invention:

FIG. 1 is a perspective view of the device constructed in accordance with the present invention as located in an upright use attitude;

FIG. 2 is an end elevational view showing the device illustrated in FIG. 1 in a collapsed or folded storage attitude;

FIG. 3 is a top plan view of the device in its storage attitude as shown in FIG. 2;

FIG. 4 is a partial perspective view of an apex portion of the device prior to the interconnection of the plate rings; and FIG. 5 is a plan view of one of the trianularly shaped plates of the device.

DESCRIPTION OF THE INVENTION

Referring now to the drawing and more particularly to FIG. 1 thereof, the target device 10 of the present invention includes a base plate 12 generally planar square configuration. The base plate 12 has an upper surface 14 and a lower surface 16, and is formed from thin sheet aluminum material as is the remainder of the target 10, aluminum having the characteristics of being readily "observable" by radar units, being easily fabricated in the desired configuration and having high strength characteristics.

Secured to the upper surface 14 of the base plate 12 are a set of four quarter panels 18, each panel being of right angle isosceles triangular configuration and being hingedly connected to the base plate 12 along a first base edge 19 by means of interconnected hinges 20 and 22. The hinges 20, 22 are connected to the upper surface 14 of the base plate 12 and to the individual quarter plates 18 respectively by means of rivets 24. Such hinge plates 20, 22 in turn include hinge knuckles 26, 28 respectively, which when positioned adjacent to each other receive a connector rod 30 therethrough for pivotally mounting the hinge plates on the base plate. Thus the four top quarter plates 18 are pivotally mounted on the base plate 12 in such a manner that they are adapted to move from a flat storage position with respect thereto, as shown in FIG. 2, to an upright or use position as shown in FIG. 1. In the use position, second base sides 32 of each of the quarter plates 18 are located in a generally vertical line with respect to each other and are generally perpendicular to the plane of the base plate 12.

The bottom surface 16 of the base plate 12 is similarly provided with a set of four bottom quarter plates 34, each hingedly conected to the base plate 12 in a manner similar to that as described above in connection with the four quarter plates 18. Each of the quarter plates 18, 34 may be formed with stiffening ribs 36 that extend in parallel relation to both the second base side 32 and the hypotenuse side 38 thereof of each plate. The triangular quarter panels 18, 34 are further formed with central openings 40 which are adapted to be aligned with similar openings 42 as formed in the base panel 12 when the quarter panels are in face-to-face disposition in the flat storage position of the device. The alignment of the openings 40, 42 enables the target 10 to be easily picked up and transported by the insertion of one's fingers through such aligned openings. The openings 40, 42 not only reduce the weight of the device, but in the position of use wind can move past and through the plates when the device is placed in the rigging of a small vessel, which accordingly helps to reduce the sail effect and thus increases its position stability.

Referring now to FIGS. 1 and 3 of the drawing, the quarter plates 18 and 34 are shown pivotally movable from a face-to-face disposition with respect to the base plate 12 in a storage or non-use position (FIG. 3), to an elevated or upright position (FIG. 1), wherein the plates 18 and 34 are disposed perpendicular to the base plate 12. In such upright position, the second base edges 32 of the plates are disposed proximate to each other and generally in-line with their vertical axis passing centrally through the base plate 12. Also when in a storage position, as shown in FIG. 3, each of the second base edges 32 is disposed adjacent to a first base edge 19 but slightly separated therefrom so as to reduce required tolerances.

As shown more clearly in FIG. 1, two of the quarter panels 18 and 34 of each set thereof and which are located in opposed relation to each other have a ring 44 secured at the upper apex thereof, each of the rings 44 being formed with a relatively large opening 46 therein. The other remaining quarter panels 18 and 34 of each set similarly have a ring 48 secured thereto each of which has a relatively smaller opening 50 formed therein. Each ring 48 has an overall outer dimension that enables it to fit through the opening 46 of the ring 44. As further shown in FIGS. 3 and 5, each of the rings 44 and 48 is pivotally connected to its respective quarter plate 18 or 34 by a rivet 52. It should also be clear as illustrated in FIG. 4 that when the several quarter plates 18 and 34 are located in their upright use position, each set of the rings 44 and 48 are respectively pivotally movable towards each other for placement in face-to-face contact. Also by sequentially locating the top and bottom sets of the rings 44 in face-to-face contact with each other with their openings 46 aligned and thereafter pivotally moving sets of smaller rings 48 towards each other so that their openings 50 are aligned, each set of smaller rings 48 can be inserted through the aligned openings 46 of a set of larger rings 44. In such an attitude, a flexible cord or a line 54 is easily passed through the aligned smaller openings 50 as shown in FIG. 1, and knotted or otherwise fastened so as to assure the securement of the sets of rings 44 and 48 together, thereby locking the plates 12 in the upright assembled position. It is also seen that maintenance of such attitude of the plates assures the location of the reflector device 10 in an upright attitude even upon mounting of the device on the rigging or mast of a small boat. In use, the radar reflector device as suspended from the rigging or mast will provide a positive radar signal to radar equipped marine vessels to clearly indicate the position of the boat on which the device is mounted.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A foldable radar target, comprising a base plate of generally planar configuration, a set of four top quarter plates each of right angle triangular configuration and each having a first base side hingedly connected to the upper surface of said base plate along two intersecting lines, a set of four bottom quarter plates each of right angle triangular configuration, and each having a first base side thereof hingedly connected to the lower surface of said base plate along two intersecting lines, the second base sides of said top and bottom quarter plates respectively adapted for proximal disposition to each other along a generally vertical line when said target is in an upright use position and for disposition to the first base side of an adjacent quarter panel when said target is in a generally flat, folded, storage position, each of said quarter panels having means disposed at the terminal end of its second base side distal from said base plate when in said upright position for simultaneously suspending said target as from a boat and for maintaining said target in an upright position, said means for suspending and maintaining said target in an upright position including rings disposed at said terminal second base ends, the rings of said top and bottom quarter plates respectively being interconnectable with each other.

2. The target set forth in claim 1, said rings being pivotally connected to said quarter plates, each set of quarter plates having two rings having a relatively large opening disposed on opposed quarter plates of such set, and two rings having a relatively smaller opening on those plates adjacent thereto, said larger rings and said smaller rings of each set adapted for face-to-face relative disposition to each other, wherein said smaller rings are further adapted for disposition at least partially through the coextensive opening of said larger rings, whereby a flexible line extending through said smaller openings maintains said plates in upright position with respect to said base plate.

* * * * *